United States Patent [19]

Cohon

[11] 4,118,760

[45] Oct. 3, 1978

[54] ADJUSTABLE HANGER FOR ELECTRIC LIGHTS

[76] Inventor: Bertram J. Cohon, 317 Summit Ave., Hackensack, N.J. 07601

[21] Appl. No.: 757,686

[22] Filed: Jan. 7, 1977

[51] Int. Cl.[2] ..... F21V 21/00; F21S 1/12; F21S 3/10

[52] U.S. Cl. ..... 362/239; 362/258; 362/270

[58] Field of Search ..... 240/3, 88, 73, 73 QD, 240/52 R, 52.1, 78 R, 85 R; 248/343; 362/237–239, 258, 269, 275, 285, 387, 407, 418, 419, 432, 433, 437, 438, 439, 449, 270

[56] References Cited

U.S. PATENT DOCUMENTS

| | | | |
|---|---|---|---|
| 1,695,061 | 11/1928 | Robinson et al. | 240/52 R X |
| 2,721,929 | 10/1955 | Schwartz et al. | 240/1.3 |
| 3,246,074 | 4/1966 | Neumann et al. | 248/343 X |
| 3,719,818 | 3/1973 | Porter et al. | 240/52.1 X |

*Primary Examiner*—J D Miller
*Assistant Examiner*—Peter S. Wong
*Attorney, Agent, or Firm*—Kirschstein, Kirschstein, Ottinger & Cobrin

[57] ABSTRACT

A hanger on which one or a plurality of electric lamps is slidably positionable along an elongated housing having non-electrified rails. The hanger includes a different resiliently extensible helical electrical cord to supply electric power to each lamp. Each helical cord is longitudinally disposed within the housing; when there is more than one lamp, the helical cords of the additional lamps are each disposed in a separate container within the housing to prevent entanglement of the cords when the positions of the lamps are adjusted. The helical cords in their relaxed positions have a diameter greater than the width of a slot in the housing so that the helical cord cannot protrude or fall from the housing. The present hanger allows installation of the unit without the services of an electrician, and because the lamps can slide on the rails, the position of each lamp is fully adjustable longitudinally of the housing. The lamps are swiveledly mounted so that any desired disposition or orientation of light emanating from the unit may be attained. The unit may be used with standard electric light bulbs, spotlights, floodlights or with any other type of electric lamp.

47 Claims, 10 Drawing Figures

ADJUSTABLE HANGER FOR ELECTRIC LIGHTS

BACKGROUND OF THE INVENTION

1. Field of the Invention

Hangers for adjustably slidable mounting of electric lamps.

2. Description of the Prior Art

The slidable adjustable mounting of electric lamps is desirable in many instances where illumination is required at diverse areas within the same general location. Typical instances where it is desirable to move, shift or reposition lighting facilities include effect lighting, spot lighting, area lighting and work lighting in homes, and activities in drafting rooms, machine shops, home workshops, dentist's and doctor's offices, hospital operating rooms, various types of factories, especially process control rooms or laboratories of chemical plants and assembly lines of automobile and appliance factories, etc. Other activities such as reading or writing, e.g. at a desk or table, in a library or study, etc. often require a periodic shifting of the light source or of the concentration of the lighting.

Some prior art installations have entailed the use of bus bars and specially designed contacts for use with bus bars, which required the services of a skilled and highly paid electrician for installation and servicing. Other prior art has contemplated channel members running along a wall or ceiling. Typical prior art devices are disclosed in U.S. Pat. Nos. 507,364; 1,757,617; 2,858,381; 3,718,816 and 3,885,147.

A major problem with prior art installations, commonly known as "track" lighting, was the presence of bare elongated conductors to which electrical connectors were designed to be detachably physically and electrically engaged. Considerable ingenuity and expense was required to make certain that such engagement was secure, as well as quickly and easily manipulatable, inasmuch as the tracks usually were situated in locations, such as ceilings, where accidental disengagement could be dangerous to occupants of a room, and where access to the tracks for installation, change or renewal of a lamp, might be precarious. Moreover, the presence of electrified bare conductors, even though shielded, represented a dangerous situation which restricted their use to areas that were normally inaccessible to children and accessible only with difficulty to adults.

SUMMARY OF THE INVENTION

1. Purposes of the Invention

It is an object of the present invention to provide an improved track hanger for adjustably mounting an electric lamp.

Another object of the invention is to provide a lighting system which permits easy and ready adjustability of one or several lighting units.

A further object of the invention is to provide a track hanger for a plurality of adjustably mounted electric lamps in which entanglement of the electrical cords leading to the lamps is effectively prevented.

An additional object of the invention is to provide a track hanger for an electric lamp or a plurality of lamps in which the lamps are adjustably mounted without loops or hanging lengths of electrical cord.

Still another object of the invention is to provide a track hanger for adjustably mounting an electric lamp which may be positioned on any appropriate or desired surface, or in any desired location by the user, such as a ceiling, wall or floor of an enclosure such as a room, on beams or studs, or an any solid surface to which such units may be desirably be attached.

Still a further object of the invention is to provide a lighting system which is designed to permit the user to position one or more sources of light in a multiplicity of positions, in order to be able to control the direction of the light beam toward one or more specific objects or areas.

Still a further object of the invention is to provide a track hanger for adjustably mounting one or a plurality of electric lamps which may be installed and placed in service by laymen, and which does not require the specialized services of a skilled electrician. Another object of the invention is to provide a track hanger which, despite the ability to have lighting units shifted longitudinally along a track, does not employ bare electrified conductors, nor exposed sheathed conductors.

These and other objects and advantages of the present invention will become evident from the description which follows.

2. Brief Description of the Invention

The present invention relates to shiftable electrical lamps, each including a casing, an electric light socket and a light bulb, each lamp preferably being provided with a swivel that permits universal rotational movement. Each lamp further includes a slide bracket which engages rails on an elongated tubular housing whereby to permit the lamp to be slid along the rails as desired by the user. The tubular housing has tracks to allow it to be slid in one or more mounting brackets. The mounting brackets may be positioned in any desirable location (ceiling, wall, floor, etc.) by suitable fastening devices.

Entering the tubular housing at one end is a sheathed two-wire electrical power cord provided with a male connector plug for engagement with a convenience electrical outlet and with an "in line" on-and-off switch. This switch is optional, especially in instances when each electric light socket has its individually controllable built-in switch. The power cord may be connected to one or more auxiliary sheathed two-wire power cords, wired in parallel circuitry, each auxiliary cord being attached to a different electric light socket. The interconnectable ends of the cords are contained in a box which is slidable into an open end of the housing and is secured in place. One end wall of the box acts as an end cap for the tubular housing. A similar box is utilized to cap the other open end of the tubular housing.

Each cord includes a segment that constitutes a resiliently extensible helical sheathed electrical cord which has a predetermined idle length and upon the endwise application of tension can be pulled to assume any desired length within a given range, the coil being generally but not necessarily self-retractable to any desired intermediate length upon the reduction of endmost applied forces. The coil is capable of maintaining its coiling upon being retracted. This maintains the segment in a neat, orderly and compact mode at all times, preventing the cord from becoming entangled on itself or jammed in the housing in which the coil is situated. The function of the helical segment is to prevent the cord from becoming tangled, and the segment is not intended to exert an appreciable force on any component to an extent capable of moving or dislodging the component.

The helical segment is preferably made in a well known manner by coiling a linear length of plastic-coated electrically conductive wire onto a mandrel which is preferably but not necessarily already coated. Then, heat is applied at a temperature capable of deforming the plastic and for a time sufficient to allow the plastic to assume its new configuration without any residual stress. These operating parameters depend on the dimensions of the mandrel as well as the type of plastic. On cooling, the plastic will maintain its new configuration and tend to resume it if deformed, e.g. stretched, therefrom.

When more than one lamp is used, in order to prevent the helical segments from entangling with one another, the tubular housing is provided, internally, with one or more containers, a different one for each different lamp, each capable of being slid into the housing and held in place, each container including a lengthwise passageway in which the associated helical segment is disposed independently of all the other segments of the other power cords. Each container includes a runway to hold the other power cords separate from the associated helical segment in that container. Furthermore, each container has an open bottom to allow free movement of an end of the helical segment which is attached to the lamp whose bracket is affiliated with that container. Such free movement is also permitted by a longitudinal slot in the bottom of the housing between the rails. The width of the slot is narrower than the diameter of the coiled segment whereby the segment, even when relaxed and sagging, will not protrude from the housing and will remain concealed in the hanger. Each lamp is alloted a range of movement which is restricted to within the ends of its associated container so that no lamp can overlap the range of movement of any other lamp.

In a preferred embodiment, the hanger accommodates the adjustable mounting of a plurality of electric lamps. The elongated tubular housing has one side adapted to be placed against the wall of a room, which may be a ceiling, a wall, a column, a soffit, or a floor.

The end of each helical segment which is connected to its respective lamp extends to the lamp through its respective bracket. The bracket is provided with a cord guide tube which runs through the slot in the housing. The lower end of the cord guide tube may be provided with a grommet to prevent the cord from becoming abraded.

The housing is preferably of rectangular cross-section and the rails preferably extend from the bottom edges of the housing in a configuration such that the rails are coplanar and perpendicular to the side walls of the housing.

Each lamp may include a swivel so that the lamp can be rotatably adjusted with respect to the housing to accommodate for various lighting requirements. In order to prevent excessive twisting of the end of the cord, means is included to restrict the rotation of the lamp to less than 360°.

When the number of the helical cords is more than two, so that a plurality of containers is provided, a first container may be provided with terminal end means for physically coupling this end of the first container with an end of a second container in contiguous tandem relationship. The terminal end means on one end of each container will typically be a joining tab, with the terminal end means on the other end of the container being a tab retainer.

The present invention provides a unique application of wiring methods, the use of compartmentalized wiring modules, and a combination of swivelling devices and slides, so as to achieve a lighting system which permits wide adjustability of one or several lamps.

The hanger of the present invention provides several salient advantages. The invention permits the lengthwise adjustable mounting of one or a plurality of electric lamps, and swivelable orientation of each lamp. Entanglement of the electrical cords leading to the lamp is effectively prevented. The electric lamp is mounted without loops or hanging lengths of electrical cord. There are no bare electrical conductors that can be touched by an instrument. The hanger can be positioned on any appropriate or desired surface. The hanger can be installed by a layman. Finally, the present hanger is inexpensive to fabricate and assemble, is of low cost, and is rugged and reliable in service.

The invention accordingly consists in the features of construction, combinations of elements and arrangements of parts which will be exemplified in the devices hereinafter described and of which the scope of application will be indicated in the appended claims.

BRIEF DESCRIPTION OF THE DRAWINGS

In the accompanying drawings in which are shown several of the various possible embodiments of the invention.

DETAILED DESCRIPTION OF THE PREFERRED EMBODIMENTS

Figure 1:
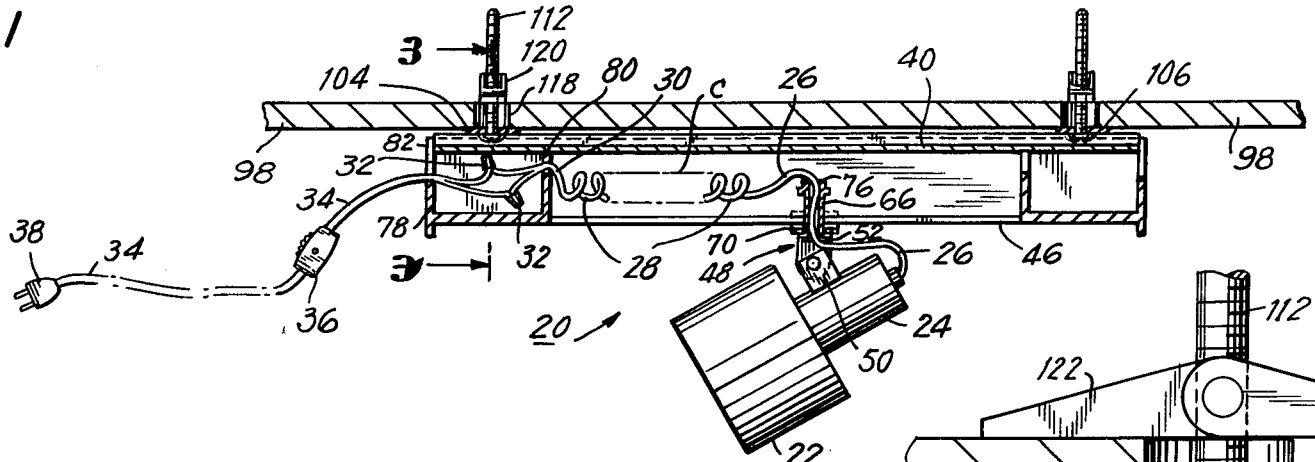
FIG. 1 is a longitudinal sectional view of a one-lamp embodiment of track hanger of the present invention.

Referring now to FIG. 1-4, a single lamp hanger 20 is shown. The hanger is characterized by the provision of a single lamp 22 within which an electric light bulb, not shown, is mounted in a light bulb socket 24. The socket 24 receives electric current through an end 26 of a two-wire insulatingly sheathed power cord C including an intermediate resiliently extensible helical segment 28. The other end 30 of the cord is secured by junction connectors 32 to a two-wire supply cord 34. The cord 34 includes an on-off line switch 36 and terminates at a male electrical plug 38 constructed to engage a source of electricity which typically is the usual female wall or floor convenience outlet.

Figure 2:
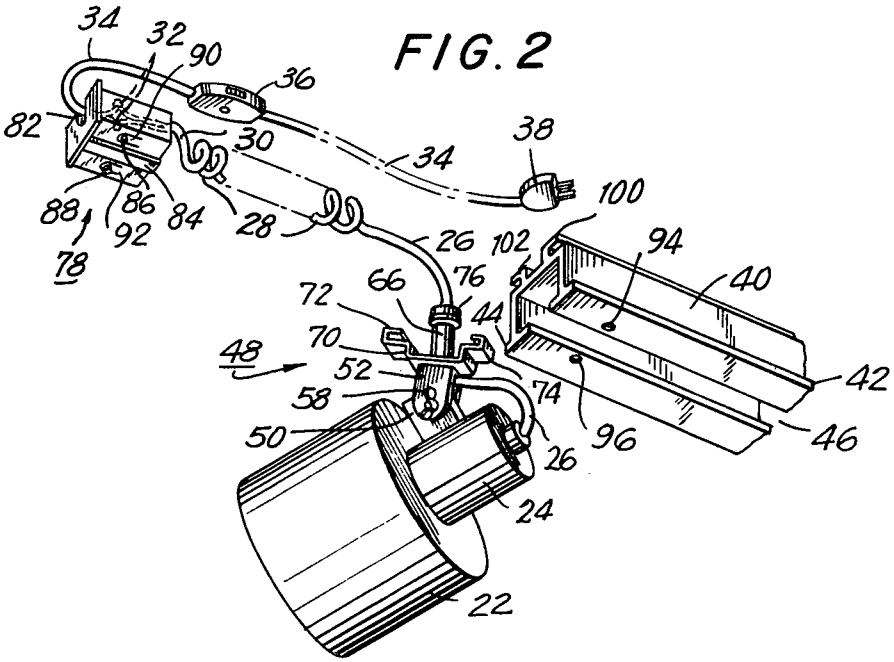
FIG. 2 is an exploded perspective view of said track hanger.
Figure 3:
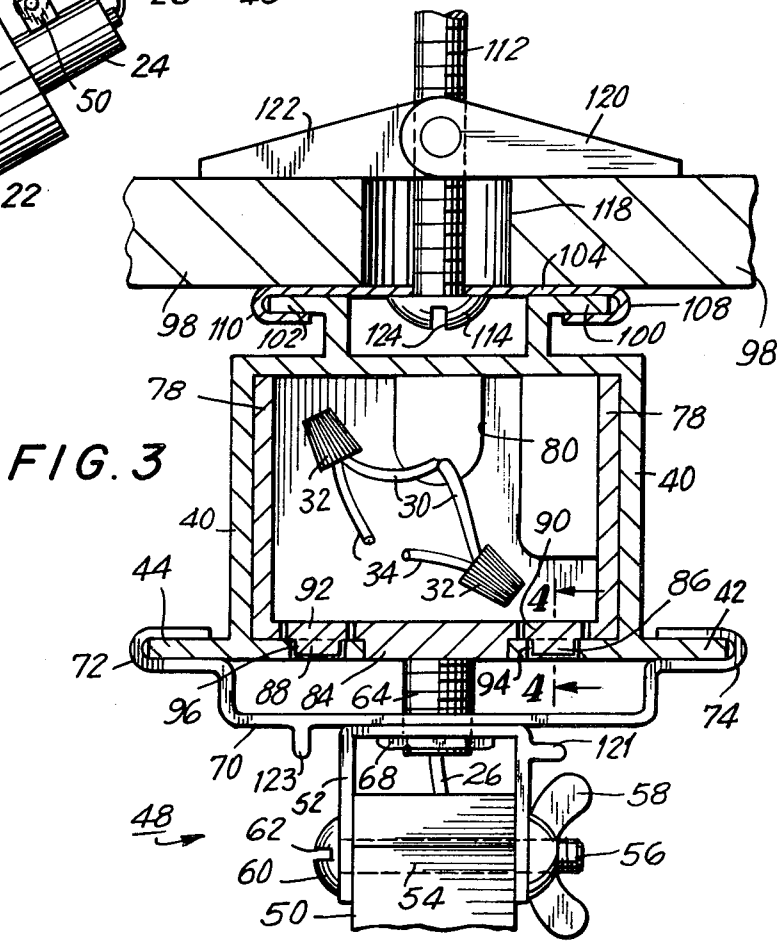
FIG. 3 is a transverse sectional elevation view of said track hanger taken substantially along the line 3—3 of FIG. 1.

The hanger 20 includes an elongated tubular formed sheet steel, diecast zinc, extruded aluminum or molded synthetic plastic housing 40, which is best shown in FIGS. 2 and 3, and is of substantially uniform rectangular cross-section. The helical segment 28 is disposed within the housing with the central axis of the helix extending longitudinally thereof. The length of the helical segment when relaxed is a small fraction, by way of example, one-quarter of the length of the housing. The housing 40 includes two opposed laterally extending spaced coplanar longitudinal rails 42 and 44 (see FIG. 2) on the lower edges of the side walls of the housing, which rails define between their inner edges a longitudinal slot 46. The rails are perpendicular to said side walls. The helical segment 28 in its relaxed condition has a diameter greater than the width of the slot 46, so that a segment in such condition cannot hang through the slot and be exposed to view. As will appear subsequently, when the helical segment is elongated and thereby tensed, anywhere up to almost all of the length of the housing, the segment will be under longitudinal stress, and even though the diameter of the segment then may be less than the width of the slot, the segment 28 will not droop sufficiently to hang out of the slot.

The socket 24 is swiveledly mounted on a bracket 48 which is supported from the housing. The bracket includes a first member 50 which is fixed to the lamp socket and is pivotally attached to a second member 52 by a shaft 54, one end 56 of which is threaded to receive a wing nut 58. The other end 60 of the shaft is preferably slotted, as at 62, so that the tension between the members 50 and 52 may be suitably adjusted, i.e., loosely to permit manipulative rotation of the member 50 about the shaft 54 and tightened to make a semi-permanent setting of the position of the socket 24, by inserting the end of a screwdriver into the slot 62 and appropriate rotation of the wing nut 58. When the housing is emplaced on a ceiling the pivotal attachment just described permits adjustment of the lamp about a horizontal axis.

Adjustment of the socket 24 about a vertical axis is attained by providing a threaded vertical nipple 66 which constitutes a cord guide. The member 52 is attached to the lower threaded end 64 of the nipple by an adjustable nut 68 which may be loosened with a pliers, wrench or the like to permit rotatable adjustment of the member 52 and the elements dependent therefrom about a vertical axis, and thereafter tightened upwards against a plate 70 that forms part of the bracket 48.

The outer ends of the plate 70 are formed into U-shaped shoes 72, 74 which slidably engage the rails 44, 42 (FIG. 3), so that the bracket 48 and the lamp can be slidably positioned where desired along the slot 46. As best shown in FIG. 1, the cord guide tube 66 extends upwardly from bracket 48 through the slot 46, and the straight lamp end 26 of the helical segment 28 extends through said tube to the socket 24. The tube 66 preferably is provided with an upper grommet 76 to prevent abrasion of its end 26 as the assemblage of the socket 24 and the bracket 48 is slidably shifted to different locations along the housing. The extensibility of the helical segment permits the aforesaid longitudinal movement of the lamp away from one end of the housing while the resiliency of the segment enables it automatically to contract upon return movement of the lamp. The frictional engagement of the shoes on the rails, although slight, is sufficient to prevent longitudinal movement of the bracket due to any force exerted by the segment.

Figure 4:
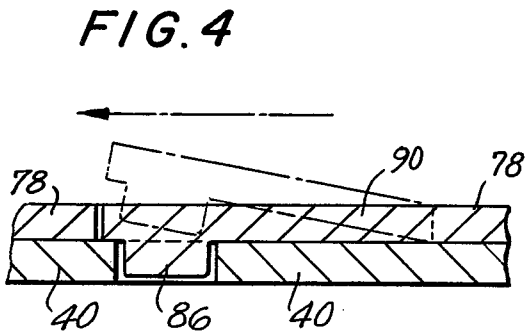
FIG. 4 is an enlarged sectional view taken substantially along the line 4—4 of FIG. 3.

The electrical connectors 32 preferably are contained in a junction box 78 provided with opposed upper end notches 80, 82 to pass, respectively, the end 30 of the helical segment 28, and an end of the supply cord 34. The junction box also is provided with a lower longitudinal ridge 84 (see FIGS. 2 and 3) which mates with and slides into an end of the slot 46, so that the box can be slidably inserted to close said end of the housing. Additionally, the lower wall of the junction box has a pair of transversely spaced buttons 86, 88 which, as best shown in FIG. 4, are pendant from the free ends of cantilevered spring strips 90, 92, so that when the junction box is emplaced in the end of the housing, the strips 90 and 92 are flexed inwardly until the buttons 86 and 88 snap into their respective recesses 94, 96. The lower edges of the buttons are rounded for easy camming action. The phantom outline in FIG. 4 shows retraction of the button 86, as when the box 78 is being removed from the housing 40.

The means to attach the upper side of the housing to a surface now will be described. In this embodiment of the invention, the surface is illustrated as a horizontal ceiling 98; however it will be understood that any suitable surface, either within or outside of an enclosed space, such as a wall, a ceiling, a floor, a beam, a stud, a soffit, a column etc. can be used.

What for convenience will be referred to as the upper side or top wall of the housing is provided with a pair of opposed coplanar laterally extending longitudinal tracks 100, 102 parallel to the rails 42, 44, as best shown in FIGS. 2 and 3. These tracks cooperate with mounting brackets 104, 106, each of which has two opposed arms, the arms 108, 110 of the bracket 104 being shown in FIG. 3. Each of the arms 108, 110 has an inner groove which slidably engages a respective track 100 or 102 so as to hold and support the hanger. Each mounting bracket in turn is attached by suitable means to a surface, in this case the ceiling 98. Referring to FIG. 3, a support bolt 112 extends upwardly through a central hole in the bracket 104, the head 114 of the bolt providing positive support for the bracket.

For installation of the assemblage, the bracket 104 is firmly first secured to the ceiling by inserting the bolt, with the bracket 104 attached, upwardly through a hole 118 in the ceiling. Two arms 120, 122 pivoted to a toggle (not shown) screwed on the bolt are at this time retracted against a spring into vertical orientation so that they can be inserted through the hole 118. Then, the arms, after being positioned above the ceiling, snap out to rest on the upper surface of the ceiling. Thereafter, a screwdriver is inserted into the central slot 124 of the head of the bolt, and the bolt is turned to pull the extended arms 120, 122 downwardly, whereby to secure the bracket 104 against the ceiling. Finally, the housing tracks 100, 102 are slid onto the arms of the brackets so that the hanger is emplaced, i.e., the housing 40 is attached to the ceiling 98.

Longitudinal movement of the lamp with respect to the housing is limited by abutment of the tube 66 against the junction box 78 at one end of the housing and at the other end of the housing against a capping box 78' similar to the box 78.

A tab 121 on the swivel member 52 and a tab 123 on the plate 48 in the path of travel of the tab 121 cooperate to restrict the rotation of the lamp to less than 360°.

Figure 5:
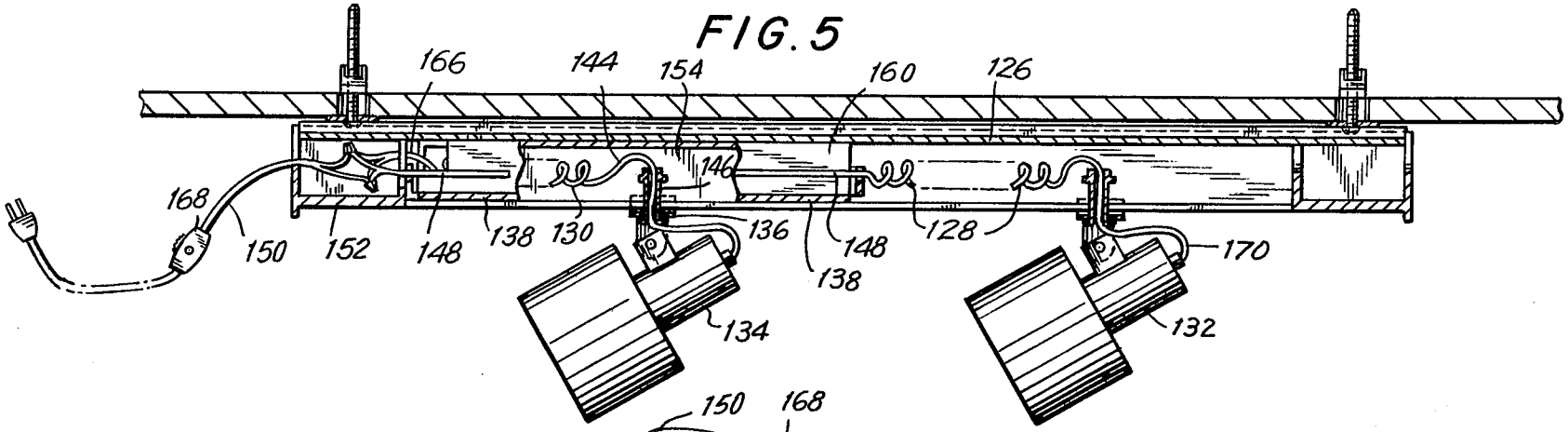
FIG. 5 is a view similar to FIG. 1 of a two-lamp embodiment of the present invention, showing a single container within the housing.
Figure 6:
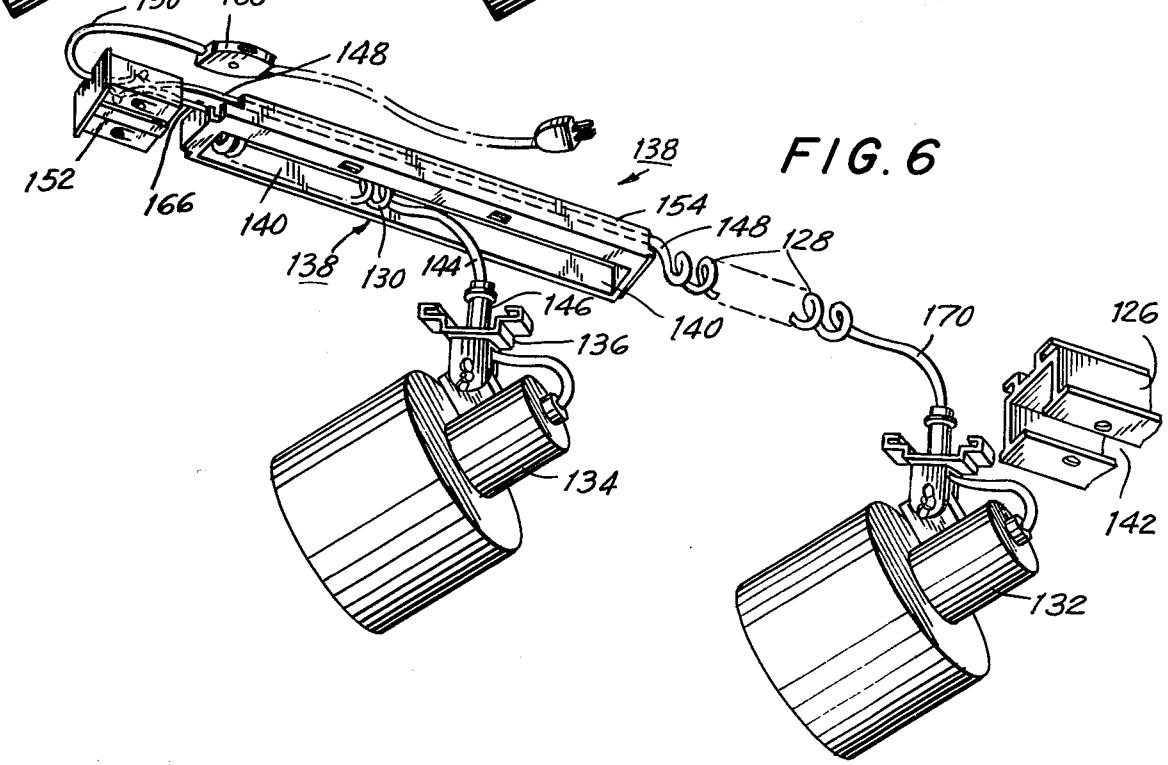
FIG. 6 is a fragmentary exploded view of the hanger of FIG. 5.
Figure 7:
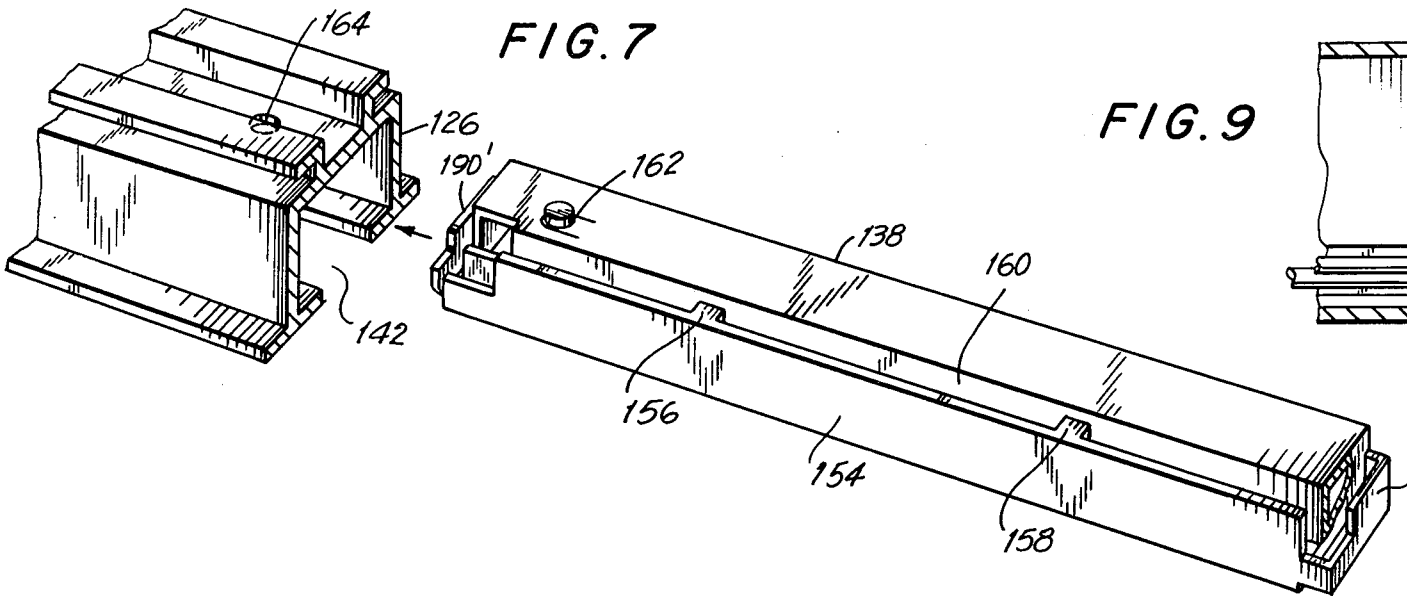
FIG. 7 is a fragmentary perspective of a housing and an associated container.

Referring now to FIGS. 5, 6 and 7, a second hanger 126 is shown in which more than one, namely two, electric lamps and corresponding power cords with helical segments are provided, and in which an internal container within the housing is included to isolate the second helical segment. The hanger 126 has two power cords with helical segments 128, 130 and respective dependent electrical lamp sockets 132 and 134; the helical segment 128 and its associated socket 132 are essentially the same as the helical segment 28 and socket 24 described above. The second socket 134 and its appurtenances, including a bracket 136, likewise are essentially the same except that the straight run of the power cord extending from the helical segment 130 is longer than that extending from the segment 128.

The additional novel features of the track hanger of FIGS. 5, 6, and 7, beyond those novel features of the invention described with respect to the first embodiment of the invention, are concerned with the disposition of the helical segment 130, which is located in a unique internal container 138 that is slidably receivable within the housing 126.

The container 138 is exemplary of any of various types of means, such as a sleeve, series of baffles, etc., or any other suitable device to enclose the second cord 130 within the housing 126. All such means, such as the container 138, are characterized by the provision of a lower longitudinal slot, i.e., a slot 140, in the container 138 (FIG. 6), above a slot 142 in a housing 138, so that the straight run 144 of the helical segment 130 passes via a cord guide tube 146 through both the slot 140 in the container 138 and the slot 142 in the housing 126, whereby the cord run 144 can be physically and electrically connected to the lamp socket 134. As discussed supra, the primary function of the container 138 is to prevent the helical segment 130 from becoming entangled with the helical segment 128, as the relative positions of sockets 132 and 134 along the housing 126 is changed. This consideration of preventing entanglement is especially important with regard to the run 148 of the helical segment 128 which extends from said helical 128 for connection with the power cord 150 within the junction box 152.

In order to assist in isolation of the cord run 148, the container 138 is provided with another novel element consisting of a baffle or partition member 154 which preferably is provided with one or more inwardly extending overhanging tabs, 156, 158 (FIG. 7). The longitudinal baffle 154 and the parallel adjacent wall 160 of the container 138 define a longitudinal channel that receives the run 148 that extends through the channel to the junction box 152, so that a physical separation of the run 148 from the helical segment 130 is attained. The tabs 156, 158 hold the run 148 in place.

The container 138 is provided with an upper protuberance 162 (FIG. 7) which preferably is similar in configuration and function to the button 86 and the strip 90 described supra, namely, in that the button portion of the protuberance 162 extends into a recess (opening) 164 in the housing 126 when the container 138 is emplaced within the housing 126, so that the container 138 will not be displaced accidentally within the housing 126 when the position of the cord guide tube 146 together with the bracket 136 and socket 134 is changed by manually sliding the bracket 136 longitudinally along the housing 126.

It is noted (FIGS. 5 and 6) that a common means consisting of the power cord 150 is provided to supply electricity within the junction box 152 to both the cord run 148 and the cord run 166 of the helical segment 130. Alternatively, separate power cords may be provided for each cord run 148, 166. Similarly, a single on-off line switch 168 is provided in the power cord 150; alternatively, individual switches may be provided in the separate power cords leading to the cord runs 148, 166; or individual switches may be provided at each socket 132, 134.

The preferred configuration of the container 138 includes end means for engaging the container 138 in tandem to an adjacent container in instances where three or more helical segments are provided and correspondingly two or more containers are provided, i.e., a container generally will be provided for each additional helical segment beyond the first segment, and where there are more than two helical segments, then more than one container will be provided.

Figure 9:
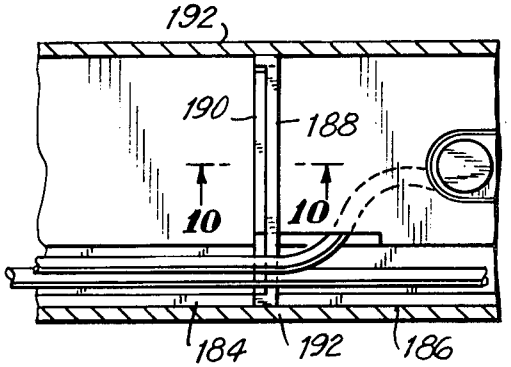
FIG. 9 is a fragmentary enlarged sectional view taken substantially along the line 9—9 of FIG. 8.
Figure 10:
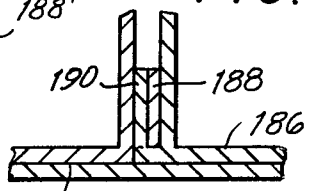
FIG. 10 is a fragmentary sectional view substantially along the line 10—10 of FIG. 9 and showing a locking arrangement for adjacent containers.
Figure 8:
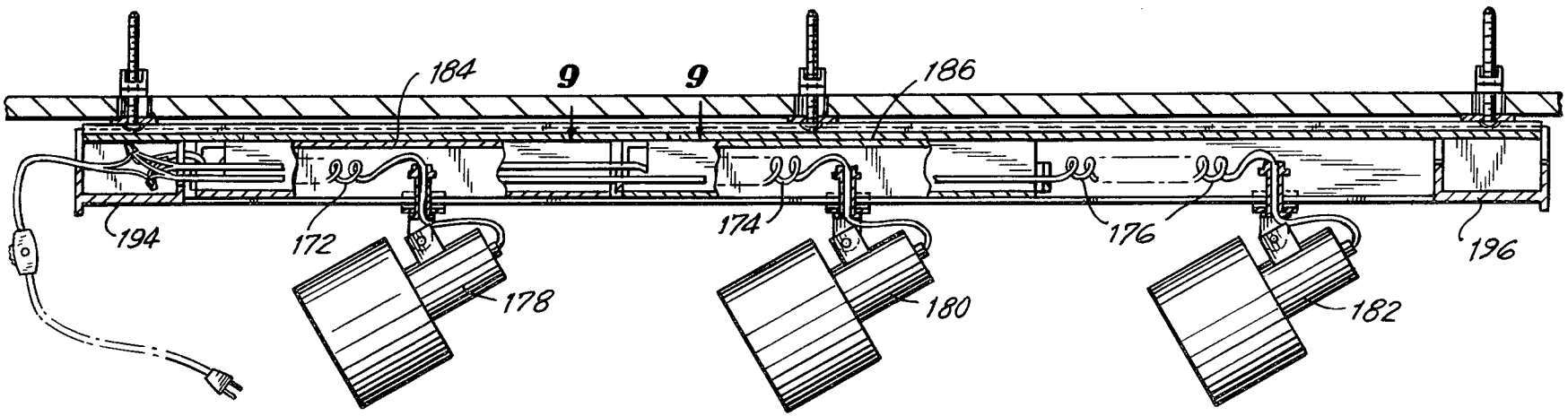
FIG. 8 is a view similar to FIG. 1 of a three-lamp embodiment of present invention.

A preferred means for locking the containers together in tandem is best shown in FIGS. 8, 9, and 10. Referring first to FIG. 8, three helical segments 172, 174 and 176 and respective electric lamp sockets 178, 180 and 182 are shown; thus, as discussed above, in FIG. 8 two containers 184 and 186 are used, with the helical segment 176 not having or being disposed within an associated container. The means for interengaging the end of the container 184 with the end of the container 186, so that the containers 184 and 186 are locked together in tandem, is illustrated in FIGS. 9 and 10. Said means consists of an upright tab 188 at the end of the container 184 and a corresponding tab retainer 190 at the associated end of the adjacent container 186. For aid in understanding the placement of said tabs, similar tabs 188', 190' have been shown in conjunction with the container 138 in FIG. 7 where the tabs are not needed since only a single container is employed; however the container 138 is typical and when employed in multiple as in FIGS. 8, 9 and 10 can be used for endwise locking engagement. The foregoing definitions will be understood to encompass and include any suitable cooperating end members, such as baffle members, a baffle or lip extending into a recess, one or a plurality of plugs or rods which extend into cooperating recesses or holes, a spring-loaded clip means, etc., all of which could be employed to connect and lock containers in tandem. It will be appreciated by those skilled in the art that any such or similar locking means can be provided at the ends of the housing 40 or 126, or housing 192 (FIG. 8), instead of or in addition to the end boxes such as boxes 78 or 152, or boxes 194 and 196 (FIG. 8), in order to furnish terminal end means for engaging a housing end with an end of a second housing, so that the housing and the second housing may be locked together in tandem; the end boxes per se could also be provided with suitable means to permit this tandem locking of housings to be accomplished.

It thus will be seen that there are provided track hangers for adjustably mounting one or a plurality of electric lamps which achieve the various objects of the invention and which are well adapted to meet the conditions of practical use.

Numerous alternatives within the scope of the present invention, besides those alternatives mentioned supra, will occur to those skilled in the art. In other words, as various possible embodiments might be made of the above invention, and as various changes might be made in the embodiments above set forth, it is to be understood that all matter herein described or shown in the accompanying drawings is to be interpreted as illustrative and not in a limiting sense.

Thus for example, the use of a toggle bolt assembly in conjunction with bracket 104 to secure the housing 40 to a surface is a preferred embodiment of the invention, and the use of a toggle bolt assembly does not preclude the use of any other practicable method of securing the assemblage, e.g. screws, nails, staples, cement, etc.

Having thus described the invention, there is claimed as new and desired to be secured by Letters Patent:

1. A track hanger for adjustably mounting an electric lamp, said hanger comprising an elongated tubular housing having one side adapted to be placed against a wall of a room, a pair of opposed laterally extending spaced longitudinal rails on the opposite side of said housing, said rails defining between them a longitudinal slot over said opposite side of said housing, an electric lamp socket, a bracket, said bracket having two opposed arms, each of said arms having an inner groove slidably engaging a different one of said rails, means mounting said lamp socket on said bracket, a resiliently extensible helical electrical cord, said helical cord being disposed in said housing with the central axis of the helix extending longitudinally of the housing, said helical cord in relaxed position having a diameter greater than the width of said slot, a cord guide tube, said cord guide tube extending from said bracket through said slot, one end of said cord passing through said cord guide tube and being physically and electrically connected to said lamp socket by means of said cord guide tube, means to supply electricity to the other end of said cord so that an electric lamp when in said lamp socket may be lit, and means to attach said one side of said housing to a surface.

2. The track hanger of claim 1 in which the means to supply electricity to the other end of the cord includes a switch.

3. The track hanger of claim 1 in which the means to attach the housing to a surface comprises a second pair of opposed laterally extending longitudinal rails on the one side of the housing, together with at least one mounting bracket, said mounting bracket having two opposed arms, each of said arms having an inner groove so that each of said arms slidably engages a different one of said second pair of rails, and means to attach said mounting bracket to a surface.

4. The track hanger of claim 1 in which at least one end of the cord guide tube is provided with a grommet.

5. The track hanger of claim 1 in combination with a box, said box being slidably disposed within an end of the housing, the means to supply electricity to the other end of the cord being connected to the other end of the cord within said box.

6. The track hanger of claim 5 in which the box is provided with at least one protuberance and a recess is provided in the housing adjacent the end of the housing, said protuberance retractably extending into said recess.

7. The track hanger of claim 6 in which the recess is an opening.

8. The track hanger of claim 6 in which the protuberance is a spring-loaded button.

9. The track hanger of claim 1 in which the housing is of rectangular cross-section.

10. The track hanger of claim 9 in which the rails extend from adjacent corners of the housing.

11. The track hanger of claim 9 in which each of the rails is perpendicular to a side wall of the housing.

12. The track hanger of claim 1 in which the lamp socket mounting means includes a swivel.

13. The track hanger of claim 12 in which at least a first tab is provided on the swivel, and at least a second tab is provided on the bracket, said first and second tabs cooperating when juxtaposed to restrict the rotation of the lamp socket mounting means to less than 360°.

14. The track hanger of claim 1 in which the bracket is slidably mounted on the housing from one end of the housing.

15. The track hanger of claim 1 in which the housing is provided with stop means so that the bracket cannot slide off the housing when once emplaced.

16. The track hanger of claim 15 in which stop means are provided proximate each end of the housing.

17. The track hanger of claim 1 in which the housing is provided with terminal end means for engaging the housing end with an end of a second housing so that the housing and said second housing may be locked together in tandem.

18. The track hanger of claim 17 in which the terminal end means at one end of the housing is a joining tab and the terminal end means at the other end of the housing is a tab retainer.

19. A track hanger for adjustably mounting a plurality of electric lamps, said hanger comprising an elongated tubular housing having one side adapted to be placed against a wall of a room, a pair of opposed laterally extending spaced longitudinal rails on the opposite side of said housing, said rails defining between them a longitudinal slot over said opposite side of said housing, a first electric lamp socket, a first bracket, said first bracket having two opposed arms, each of said first bracket arms having an inner groove slidably engaging a different one of said rails, means mounting said first lamp socket on said first bracket, a first resiliently extensible helical electrical cord, said first helical cord being disposed in said housing with the longitudinal central axis of the helix extending longitudinally of the housing, said first helical cord in the relaxed position having a diameter greater than the width of said slot, one end of said first cord passing through said slot and being physically and electrically connected to said first lamp socket, means to supply electricity to the other end of said first cord so that an electric lamp in said first lamp socket may be lit, a second electric lamp socket, a second bracket, said second bracket having two opposed arms, each of said second bracket arms having an inner groove slidably engaging a different one of said rails, means mounting said second lamp socket on said second bracket, a second resiliently extensible helical electrical cord, said second helical cord being disposed in said housing with the longitudinal central axis of the helix extending longitudinally of the housing, means to enclose said second cord within said housing, said enclosure means having an elongated opening above the slot in said housing, said second helical cord in the relaxed position having a diameter greater than the width of said slot, one end of said second cord passing through said opening in said enclosure means and said slot in said housing and being physically and electrically connected to said second lamp socket, means to supply electricity to the other end of said second cord so that an electric lamp in said second lamp socket may be lit, and means to attach said one side of said housing to a surface.

20. The track hanger of claim 19 in which a common means to supply electricity is provided to supply electricity to the other ends of both the first and the second cords.

21. The track hanger of claim 20 in which the common means to supply electricity includes a switch.

22. The track hanger of claim 19 in which the means to attach the housing to a surface comprises a second pair of opposed laterally extending longitudinal rails on the one side of the housing, together with at least one mounting bracket, said mounting bracket having two opposed arms, each of said arms having an inner groove so that each of said arms slidably engages one of said second pair of rails, and means to attach said mounting bracket to a surface.

23. The track hanger of claim 19 in which the one end of the first cord extends to the first lamp socket through the first bracket and the one end of the second cord extends to the second lamp socket through the second bracket.

24. The track hanger of claim 23 in which each bracket is provided with a cord guide tube, a first tube extending from the first bracket through the slot in the housing, the one end of the first cord extending through said first tube to the first lamp socket, a second tube extending from the second bracket through the registered slots in the housing and enclosure means, the one end of the second cord extending through said second tube to the second lamp socket.

25. The track hanger of claim 24 in which at least one end of each cord guide tube is provided with a grommet.

26. The track hanger of claim 19 in combination with a box, said box being slidably disposed within an end of the housing, a common means to supply electricity is provided to supply electricity to the other ends of both the first and the second cords, said common means to supply electricity being connected to the other ends of both the first and second cords within said box.

27. The track hanger of claim 26 in which the box is provided with at least one protuberance and a recess is provided in the housing adjacent the end of the housing, said protuberance extending into said recess.

28. The track hanger of claim 27 in which the recess is an opening.

29. The track hanger of claim 27 in which the protuberance is a spring loaded button.

30. The track hanger of claim 19 in which the housing is of rectangular cross-section.

31. The track hanger of claim 30 in which the rails extend from adjacent corners of the housing.

32. The track hanger of claim 30 in which each of the rails is perpendicular to a side wall of the housing.

33. The track hanger of claim 19 in which each lamp socket mounting means includes a swivel.

34. The track hanger of claim 33 in which at least a first tab is provided on at least one swivel, and at least a second tab is provided on the respective bracket, said first and second tabs cooperating when juxtaposed to restrict the rotation of the lamp socket mounting means to less than 360°.

35. The track hanger of claim 19 in which each bracket is slidably mounted on the housing from an end of the housing.

36. The track hanger of claim 19 in which the housing is provided with stop means so that the brackets cannot slide off the housing when once emplaced.

37. The track hanger of claim 36 in which stop means are provided proximate each end of the housing.

38. The track hanger of claim 19 in which the enclosure means is a container.

39. The track hanger of claim 38 in which the container is provided with a lateral longitudinal baffle, said baffle and the adjacent wall of the container defining a lateral channel, a run of cord from the other end of the first cord extending through said channel to the means to supply electricity.

40. The track hanger of claim 39 in which the baffle is parallel to the adjacent wall of the container.

41. The track hanger of claim 39 in which at least one overhanging tab is provided along the channel so that the other end of the first cord is retained in place.

42. The track hanger of claim 41 in which the tab extends from the baffle towards the adjacent wall of the container.

43. The track hanger of claim 38 in which the container is provided with at least one protuberance and a recess is provided in the housing, said protuberance retractably extending into said recess.

44. The track hanger of claim 43 in which the recess is an opening.

45. The track hanger of claim 43 in which the protuberance is a spring loaded button.

46. The track hanger of claim 38 in which the container is provided with terminal end means for engaging the container end with an end of a second container disposed in the housing so that the container and said second container may be locked together in tandem in the housing.

47. The track hanger of claim 46 in which the terminal end means at one end of the container is a joining tab and the terminal end means at the other end of the container is a tab retainer.

* * * * *